US007946072B2

(12) United States Patent
Tsai

(10) Patent No.: US 7,946,072 B2
(45) Date of Patent: May 24, 2011

(54) FLIP-UP COVER MECHANISM FOR A SIGHT

(75) Inventor: Chen-Shuo Tsai, Taichung (TW)

(73) Assignee: Asia Optical Co., Inc., Taichung (TW)

( * ) Notice: Subject to any disclaimer, the term of this patent is extended or adjusted under 35 U.S.C. 154(b) by 155 days.

(21) Appl. No.: 12/395,745

(22) Filed: Mar. 2, 2009

(65) Prior Publication Data

US 2010/0095577 A1 Apr. 22, 2010

(30) Foreign Application Priority Data

Oct. 20, 2008 (TW) ..... 97140148 A

(51) Int. Cl.
*F41A 35/02* (2006.01)
*F41G 1/38* (2006.01)

(52) U.S. Cl. ..... 42/129

(58) Field of Classification Search ..... 42/129
See application file for complete search history.

(56) References Cited

U.S. PATENT DOCUMENTS 2,593,063 A * 4/1952 Sieber ..... 431/135

* cited by examiner

*Primary Examiner* — Bret Hayes
(74) *Attorney, Agent, or Firm* — Thomas|Kayden

(57) ABSTRACT

A flip-up cover mechanism. An annular body includes two opposite through holes. A displacing member is disposed in the annular body and includes two opposite push portions and a first flange. The push portions respectively protrude from the annular body via the through holes. A cover is rotatably connected to the annular body and includes a second flange detachably engaged with the first flange. A torsion spring is connected between the annular body and the cover. When the second flange is engaged with the first flange, the cover is closed in relation to the annular body and the torsion spring is twisted to provide restoring resilience. When the push portions are respectively pushed through the through holes, the displacing member is elastically deformed to separate the first flange from the second flange and the cover is lifted from the annular body by the restoring resilience provided by the torsion spring.

2 Claims, 6 Drawing Sheets

FLIP-UP COVER MECHANISM FOR A SIGHT

CROSS REFERENCE TO RELATED APPLICATIONS

This application claims priority of Taiwan Patent Application No. 097140148, filed on Oct. 20, 2008, the entirety of which is incorporated by reference herein.

BACKGROUND OF THE INVENTION

1. Field of the Invention

The invention relates to a flip-up cover mechanism, and more particularly to a flip-up cover mechanism with secure closing and easy lifting effects.

2. Description of the Related Art

A cover mechanism is often provided on a sight, protecting optical components therein.

Referring to FIG. 1A and FIG. 1B, a conventional flip-up cover mechanism 1 is provided on a sight S, protecting optical components therein.

As shown in FIGS. 1A, 1B, and 3, the flip-up cover mechanism 1 comprises an annular body 10, a cover 20, a torsion spring 30, and a pivot 40.

As shown in FIG. 1A and FIG. 1B, the annular body 10 is connected to an end (such as an objective lens tube) of the sight S. As shown in FIG. 2, the annular body 10 comprises a first flange 11.

As shown in FIG. 1A and FIG. 1B, the cover 20 is rotatably connected to the annular body 10. Additionally, as shown in FIG. 2, the cover 20 comprises a second flange 21.

As shown in FIG. 1A and FIG. 1B, the torsion spring 30 is connected between the annular body 10 and the cover 20, and the pivot 40 is fit in the annular body 10, cover 20, and torsion spring 30.

As shown in FIG. 1A and FIG. 2, when the cover 20 is closed in relation to the annular body 10, the second flange 21 of the cover 20 abuts and is engaged with the first flange 11 of the annular body 10 and the torsion spring 30 is twisted. In another aspect, an operator can push an outer edge of the cover 20, lifting the cover 20 from the annular body 10. At this point, the second flange 21 of the cover 20 and the first flange 11 of the annular body 10 are elastically deformed, and the second flange 21 then disengages from the first flange 11. As shown in FIG. 1B, after the second flange 21 is completely separated from the first flange 11, the cover 20 is lifted by restoring resilience provided by the torsion spring 30.

Accordingly, as the cover 20 is closed in relation to the annular body 10 by engagement between the second flange 21 and the first flange 11, a secure closing effect between the cover 20 and the annular body 10 depends on the quantity of interference between the second flange 21 and the first flange 11. Specifically, the greater the quantity of interference between the second flange 21 and the first flange 11, the better the secure closing effect between the cover 20 and the annular body 10. Nevertheless, ease of a lifting effect between the cover 20 and the annular body 10 also depends on the quantity of interference between the second flange 21 and the first flange 11. Specifically, the greater the quantity of interference between the second flange 21 and the first flange 11, the lesser the ease of the lifting effect between the cover 20 and the annular body 10 (i.e. the higher the force required for the operator to push the outer edge of the cover 20). Accordingly, the secure closing effect between the cover 20 and the annular body 10 is contrary to the ease of the lifting effect therebetween. However, to obtain balance between the secure closing effect and the ease of the lifting effect and manufacturing simplicity, the secure closing effect is primarily considered, causing inconvenient lifting operation between the cover 20 and the annular body 10 for users. Moreover, during lifting and closing operations between the cover 20 and the annular body 10, the second flange 21 of the cover 20 and the first flange 11 of the annular body 10 are subjected to frictional wear which is not dependent upon the quantity of interference between the second flange 21 and the first flange 11. Thus, after long-term operation, the secure closing effect between the cover 20 and the annular body 10 is tremendously reduced.

BRIEF SUMMARY OF THE INVENTION

A detailed description is given in the following embodiments with reference to the accompanying drawings.

An exemplary embodiment of the invention provides a flip-up cover mechanism for protecting a sight. The flip-up cover mechanism comprises an annular body, a displacing member, a cover, and a torsion spring. The annular body comprises two opposite through holes. The displacing member is disposed in the annular body and comprises two opposite push portions and a first flange. The push portions respectively protrude from the annular body via the through holes. The cover is rotatably connected to the annular body and comprises a second flange detachably engaged with the first flange. The torsion spring is connected between the annular body and the cover. When the second flange of the cover is engaged with the first flange of the displacing member, the cover is closed in relation to the annular body and the torsion spring is twisted to provide restoring resilience. When the push portions of the displacing member are respectively pushed through the through holes, the displacing member is elastically deformed to separate the first flange from the second flange and the cover is lifted from the annular body by the restoring resilience provided by the torsion spring.

The annular body further comprises two opposite positioning retardant portions between which the displacing member is abutted.

The flip-up cover mechanism further comprises a pivot fit in the annular body, cover, and torsion spring.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
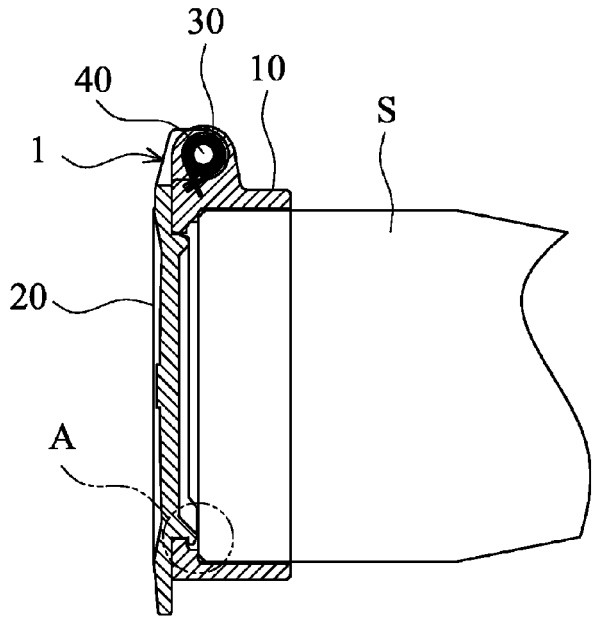
FIG. 1A ( PRIOR ART )
FIG. 1A is a schematic partial cross section and side view of a conventional flip-up cover mechanism and a sight in an operational condition.
Figure 1B:
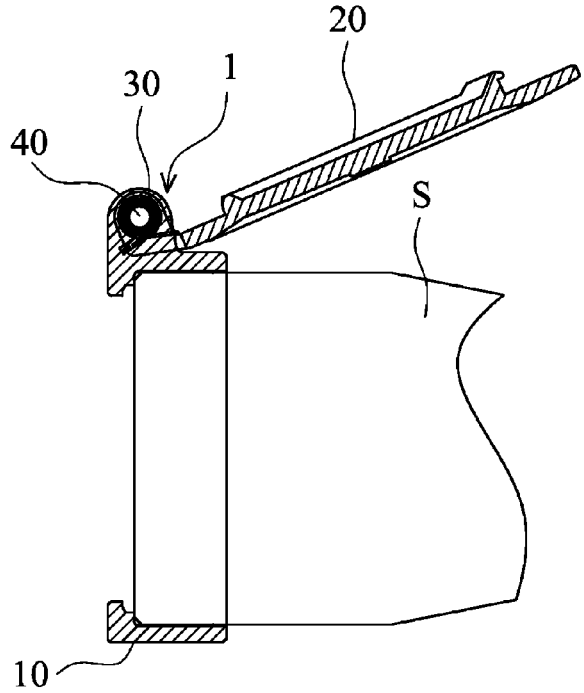
FIG. 1B ( PRIOR ART )
FIG. 1B is a schematic partial cross section and side view of the conventional flip-up cover mechanism and sight in another operational condition.
Figure 2:
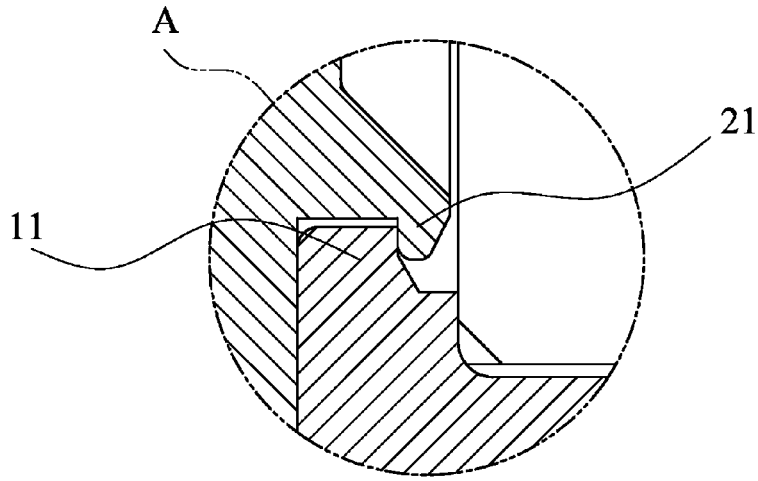
FIG. 2 ( PRIOR ART )
FIG. 2 is a partial enlarged view of FIG. 1A.
Figure 3:
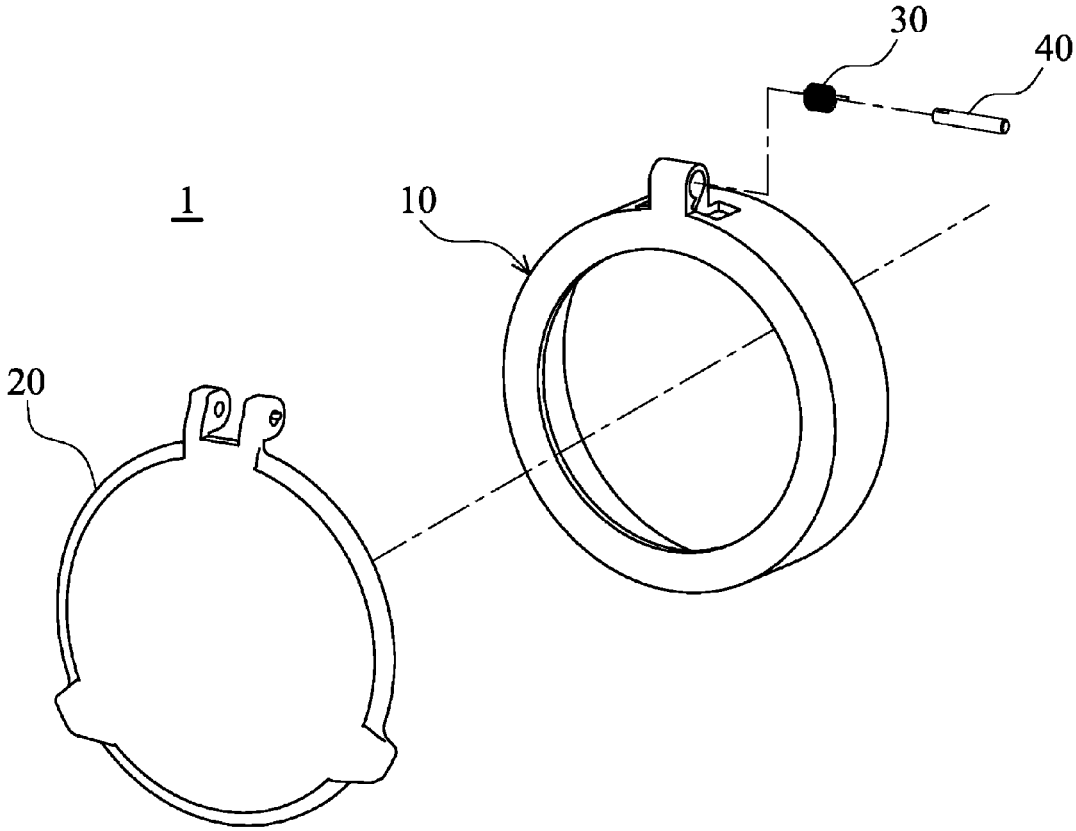
FIG. 3 ( PRIOR ART )
FIG. 3 is a schematic exploded perspective view of the conventional flip-up cover mechanism.
Figure 4A:
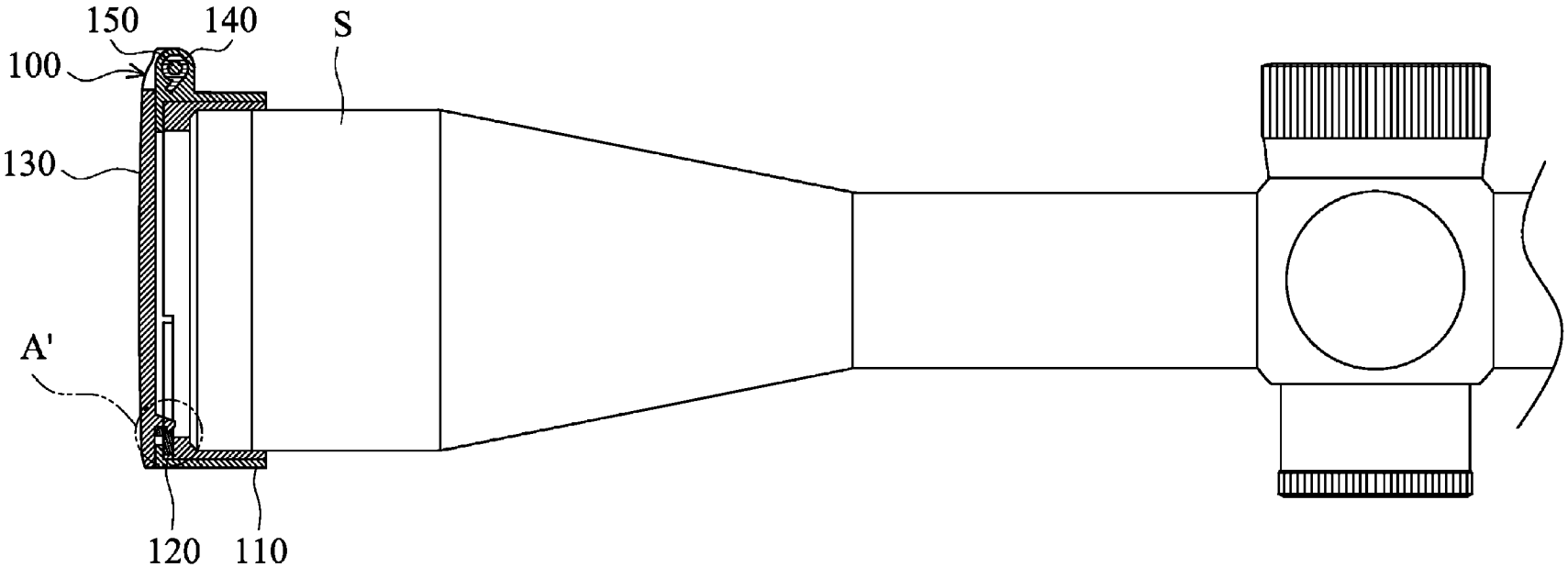
FIG. 4A is a schematic partial cross section and side view of a flip-up cover mechanism of the invention and a sight in an operational condition.
Figure 4B:
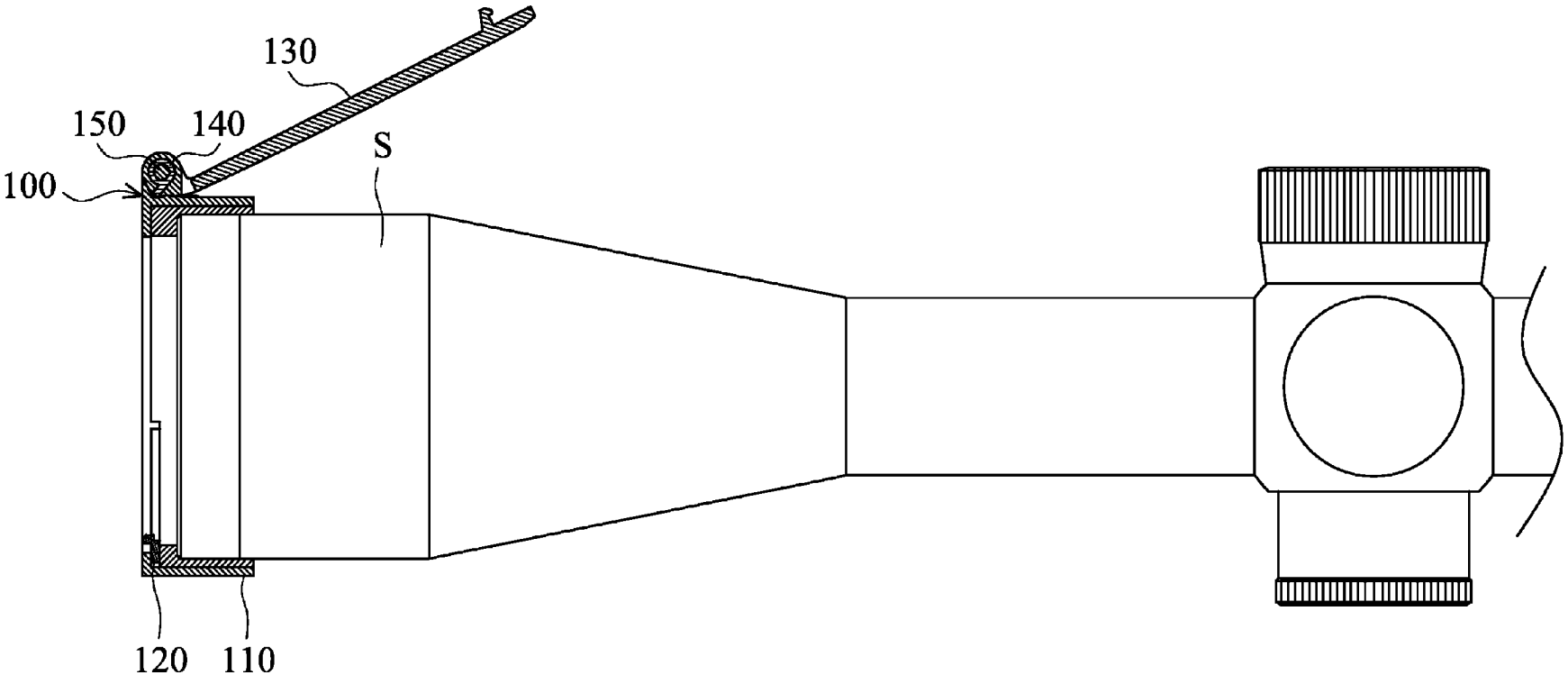
FIG. 4B is a schematic partial cross section and side view of the flip-up cover mechanism of the invention and the sight in another operational condition.

Referring to FIG. 4A and FIG. 4B, a flip-up cover mechanism 100 is provided on a sight S, protecting optical components therein.

Figure 7:
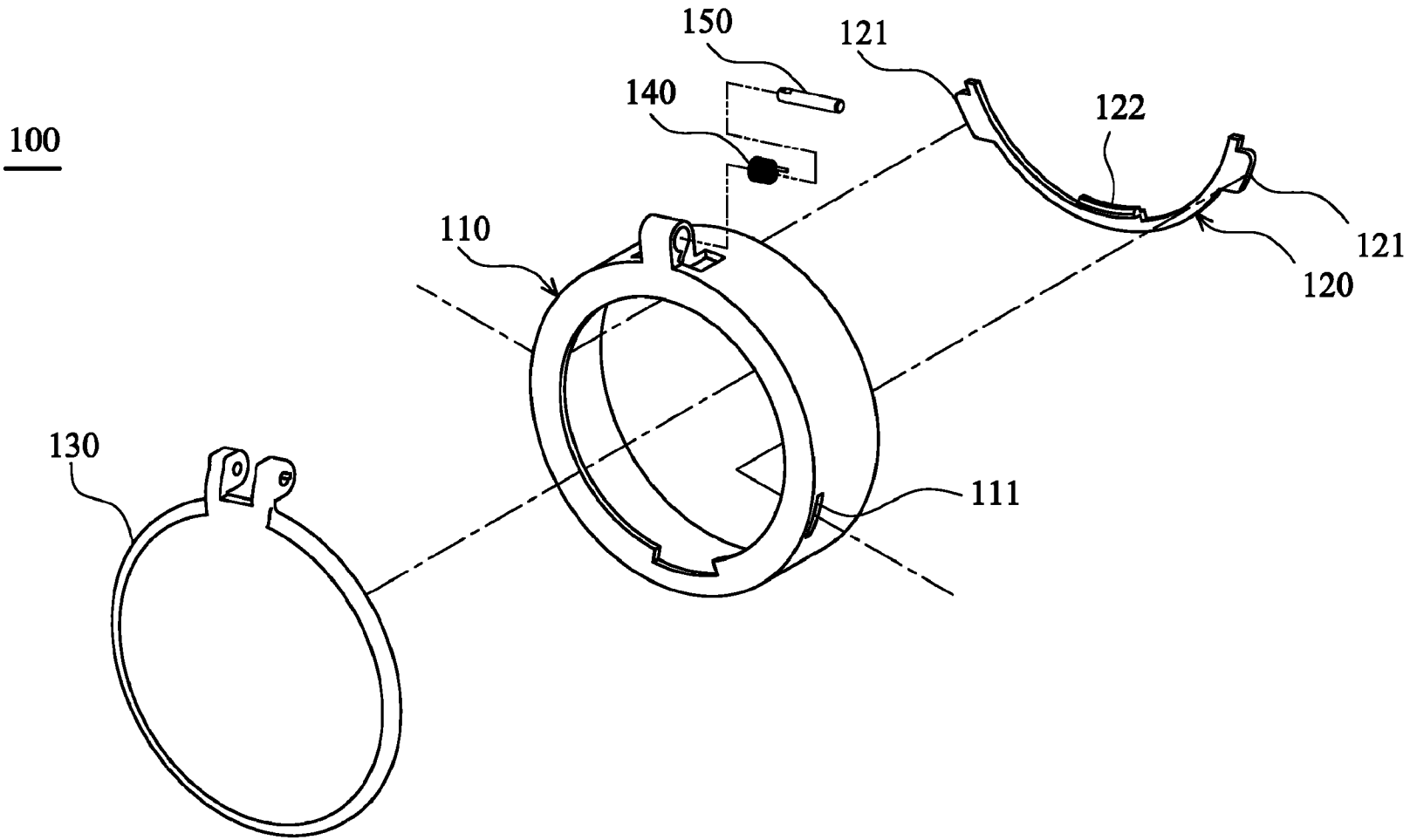
FIG. 7 is a schematic exploded perspective view of the flip-up cover mechanism of the invention.

As shown in FIGS. 4A, 4B, and 7, the flip-up cover mechanism 100 comprises an annular body 110, a curved displacing member 120, a cover 130, a torsion spring 140, and a pivot 150.

Figure 6:
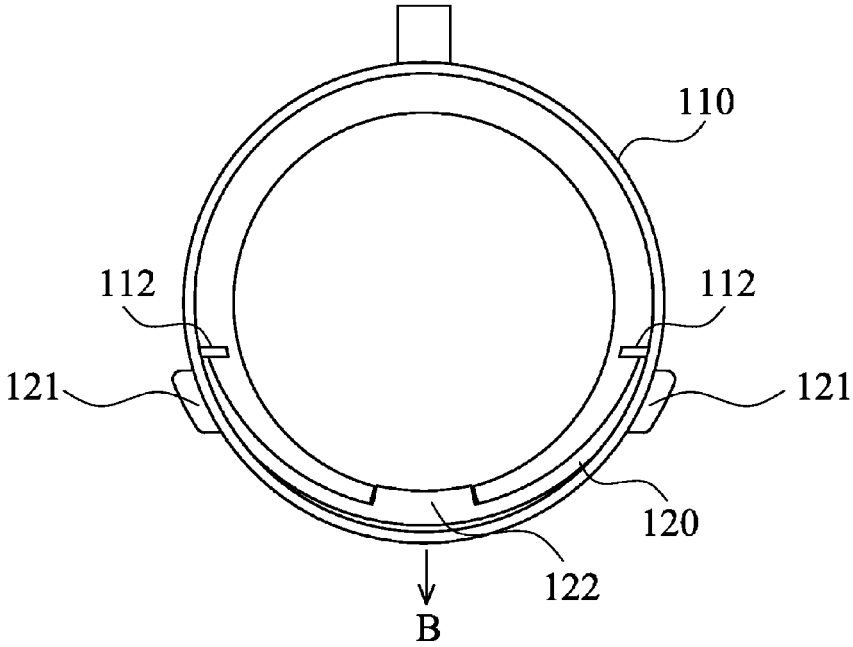
FIG. 6 is a partial left side view of FIG. 4B.

As shown in FIG. 4A and FIG. 4B, the annular body 110 may be connected to an end (such as an objective lens tube) of the sight S. As shown in FIG. 6 and FIG. 7, the annular body 110 comprises two opposite through holes 111 and two opposite positioning retardant barricades 112.

The curved displacing member 120 is disposed in the annular body 110 and is abutted between the positioning retardant barricades 112 thereof. Additionally, the curved displacing member 120 comprises two opposite push portions 121 and a first flange 122. Specifically, the push portions 121 of the curved displacing member 120 respectively protrude from the annular body 110 via the through holes 111 thereof.

As shown in FIG. 4A and FIG. 4B, the cover 130 is rotatably connected to the annular body 110. Additionally, as shown in FIG. 5, the cover 130 comprises a second flange 131 detachably engaged with the first flange 122 of the curved displacing member 120.

As shown in FIG. 4A and FIG. 4B, the torsion spring 140 is connected between the annular body 110 and the cover 130 and the pivot 150 is fit in the annular body 110, cover 130, and torsion spring 140.

Figure 5:
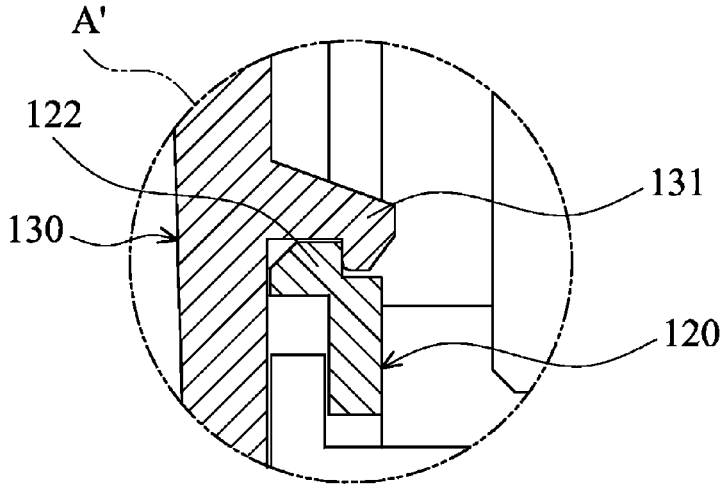
FIG. 5 is a partial enlarged view of FIG. 4A.

As shown in FIG. 4A and FIG. 5, when the second flange 131 of the cover 130 abuts and is engaged with the first flange 122 of the curved displacing member 120, the cover 130 is closed in relation to the annular body 110 and the torsion spring 140 is twisted. In another aspect, when the cover 130 is lifted from the annular body 110, an operator can inwardly push the push portions 121 of the curved displacing member 120, inwardly moving the push portions 121 through the through holes 111 of the annular body 110, and further elastically deforming the entire curved displacing member 120. Here, by limitation of the through holes 111 and positioning retardant barricades 112 of the annular body 110, the elastically deformed curved displacing member 120 forces the first flange 122 thereof to move in a direction B shown in FIG. 6 and thereby disengage from the second flange 131 of the cover 130. As shown in FIG. 4B, when the first flange 122 of the curved displacing member 120 is completely separated from the second flange 131 of the cover 130, the cover 130 is lifted from the annular body 110 by restoring resilience provided by the torsion spring 140.

Accordingly, as lifting between the cover 130 and the annular body 110 is achieved by elastic deformation of the curved displacing member 120 or movement of the first flange 122, a secure closing effect between the cover 130 and the annular body 110 does not conflict with ease of a lifting effect therebetween. Specifically, even though the quantity of interference between the first flange 122 and the second flange 131 is increased to enhance the secure closing effect between the cover 130 and the annular body 110, the lifting effect between the cover 130 and the annular body 110 can still be easily achieved. Thus, in the flip-up cover mechanism 100 of this embodiment, the secure closing effect and the ease of the lifting effect can be simultaneously provided between the cover 130 and the annular body 110. Moreover, as lifting between the cover 130 and the annular body 110 is achieved by the elastic deformation of the curved displacing member 120 or the movement of the first flange 122, frictional wear between the second flange 131 and the first flange 122 can be significantly reduced, thereby prolonging the lifespan of the flip-up cover mechanism 100.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A flip-up cover mechanism for a sight, comprising:

an annular body comprising two opposite through holes and two opposite positioning retardant barricades;

a curved displacing member disposed in the annular body and comprising two opposite push portions and a first flange, wherein the push portions respectively protrude from the annular body via the through holes, and the curved displacing member is abutted between the positioning retardant barricades of the annular body;

a cover rotatably connected to the annular body and comprising a second flange detachably engaged with the first flange; and a torsion spring connected between the annular body and the cover, wherein, when the second flange of the cover is engaged with the first flange of the curved displacing member, the cover is closed in relation to the annular body and the torsion spring is twisted to provide restoring resilience, and when the push portions of the curved displacing member are respectively pushed through the through holes, the curved displacing member is elastically deformed to separate the first flange from the second flange and the cover is lifted from the annular body by the restoring resilience provided by the torsion spring.

2. The flip-up cover mechanism as claimed in claim 1, further comprising a pivot fit in the annular body, cover, and torsion spring.

* * * * *